United States Patent [19]

Discenza et al.

[11] 4,347,411

[45] Aug. 31, 1982

[54] PROGRESSIVE SWITCH

[75] Inventors: Frank J. Discenza, Rocky Hill; Milton N. Ives, Wolcott, both of Conn.

[73] Assignee: Carlingswitch, Inc., West Hartford, Conn.

[21] Appl. No.: 212,137

[22] Filed: Dec. 2, 1980

[51] Int. Cl.[3] ..... H01H 15/00

[52] U.S. Cl. ..... 200/1 B; 200/16 C; 200/67 G; 200/68

[58] Field of Search ..... 200/5 R, 5 A, 5 B, 5 C, 200/5 D, 5 E, 5 EA, 5 EB, 5 F, 6 R, 6 A, 16 R, 16 A, 16 B, 16 C, 16 D, 16 E, 16 F, 1 V, 67 G, 68, 1 B, 157, 61.27-61.33

[56] References Cited

U.S. PATENT DOCUMENTS

| | | | |
|---|---|---|---|
| 3,281,546 | 10/1966 | Aquillon | 200/16 C |
| 3,564,372 | 2/1971 | Vogelsberg et al. | 200/157 |
| 4,249,056 | 2/1981 | MacManus | 200/1 B |

*Primary Examiner*—J. V. Truhe
*Assistant Examiner*—Morris Ginsburg
*Attorney, Agent, or Firm*—McCormick, Paulding & Huber

[57] ABSTRACT

A progressive "on" switch has one common or first contact formed with a projecting portion located alongside a complementary intermediate or second contact, and a floating contact element which is movable through successive positions to a full "on" position wherein one element edge abuts the third contact and an opposite element edge abuts fulcrum defining portions of these first and second complementary contacts.

12 Claims, 6 Drawing Figures

FIG. 1
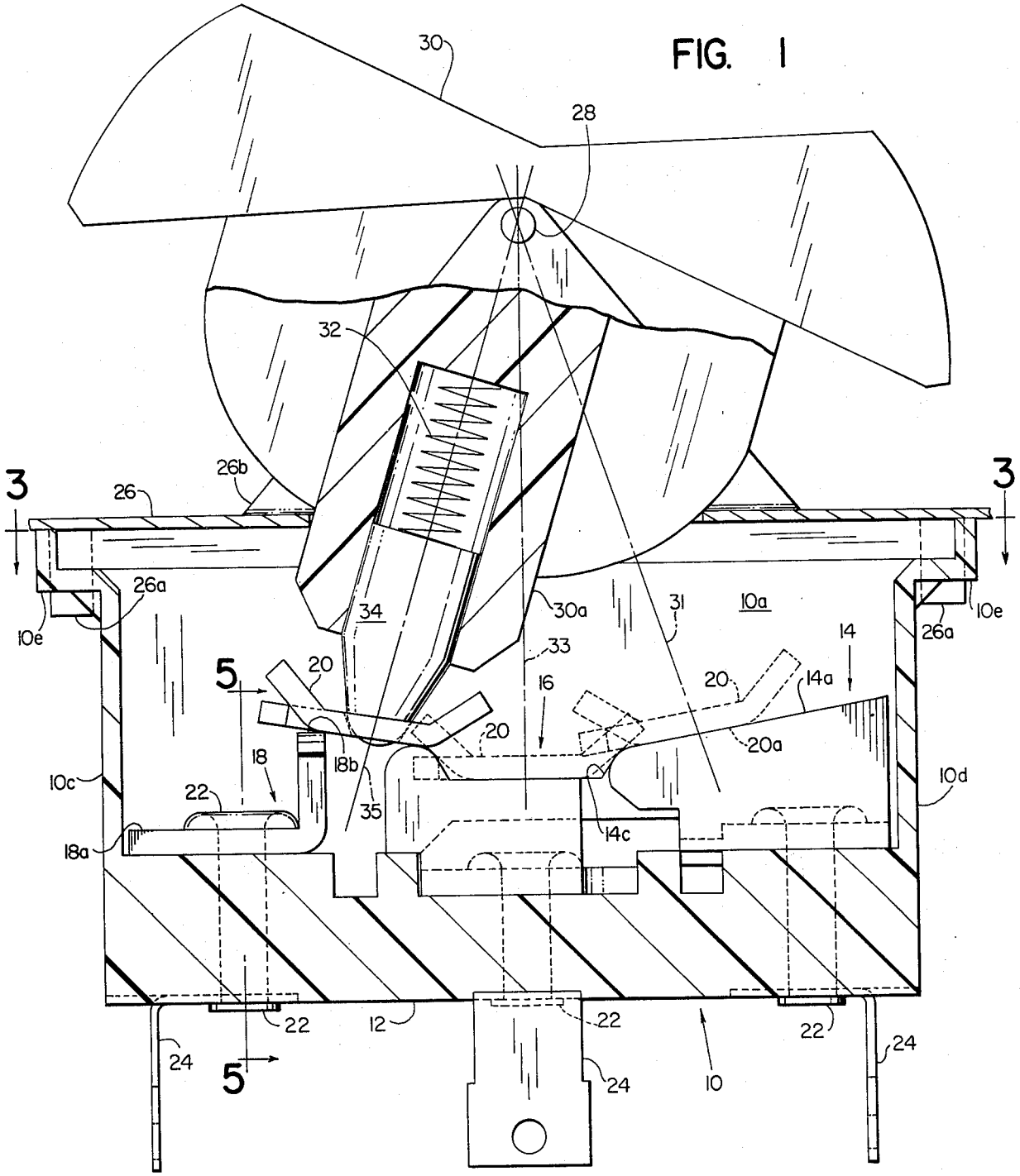
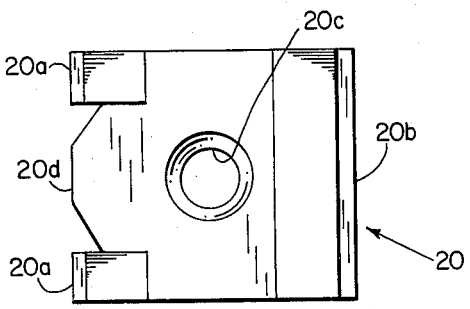
FIG. 2

PROGRESSIVE SWITCH

This invention relates generally to switches having a slidably movable contact element or lever selectively positionable within the case in response to movement of an actuating handle accessible from outside the case, and deals more particularly with an improved progressive switch or pole capable of controlling at least two electrical circuits.

Such a progressive switch is generally arranged in two electrical circuits which are to be operated in sequence as follows; both circuits off, one circuit on, two circuits on. These various conditions for the switch are generally selectable in either a forward or a reverse direction with interruption of the sequence being possible.

These functions are achieved in a switch constructed in accordance with the present invention by a switch case of plastic insulating material, which case may include a metal or plastic cover with means to movably support an actuator in the upper portion of the case or cover. The movable contact element is connected to a depending portion of the actuator for movement generally longitudinally of the case. First, second and third fixed contacts are disposed in the longitudinal path of movement of the movable or slidable contact element, and each such fixed contact is insulated from the other in the switch case as a result of the plastic case material. In accordance with the present invention the first contact defines a first position for the movable contact element wherein the underside of the element has laterally spaced regions for contacting selected portions of this first contact. A projecting portion of this first contact is provided alongside the second or center contact in the switch case such that the movable contact regions engage both the first and second fixed contacts in a second position for the movable element. Finally, the third contact is spaced longitudinally from the second and is adapted to engage the forward or leading laterally extending edge of the movable contact when said contact has its aft or other laterally extending edge still in contact with the first and second fixed contacts. Pivotal movement of the actuator may be utilized to achieve the slidable movement of the contact element through a spring loaded plunger having its lowermost end received in an opening provided for this purpose in the movable contact element. Furthermore, the movable contact element is adapted to itself pivot about selected portions of the fixed contacts so as to achieve the desired locating of the contact element in predetermined first, second and third switch positions as a result of the yieldable force of the above mentioned spring, and so that this movable contact element is adapted to be pivoted slightly as it moves from one position to another in order to achieve a more positive electrical connection as it is moved from one switch position to another. Both the fixed contacts and the movable contact element are preferably fabricated from a sheet metal material by a stamping process and hence the switch is very economical to manufacture while nevertheless being very reliable in its operation.

FIG. 1 is a vertical sectional view through a progressive switch incorporating the present invention, and illustrates the movable actuator in the full "on" position, and also suggests the "off" and an intermediate "on" position for the depending portion of the actuator, with the movable contact element being illustrated in broken lines to correspond to these alternative positions for the actuator.

FIG. 2 is a plan view of the movable contact element shown in FIG. 1.

Figure 3:
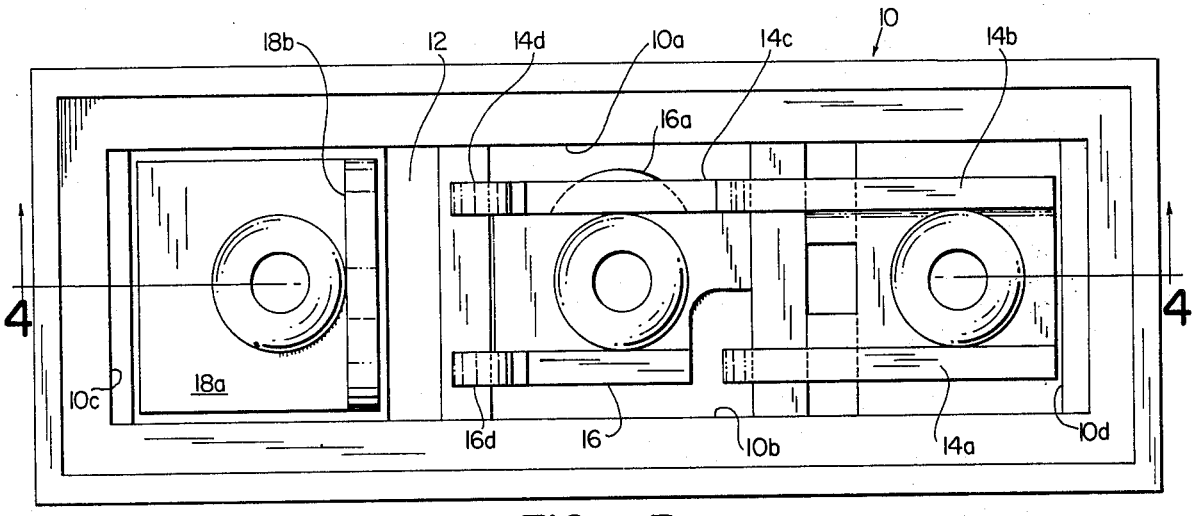
FIG. 3 is a horizontal sectional view taken generally on the line 3—3 of FIG. 1.
Figure 5:
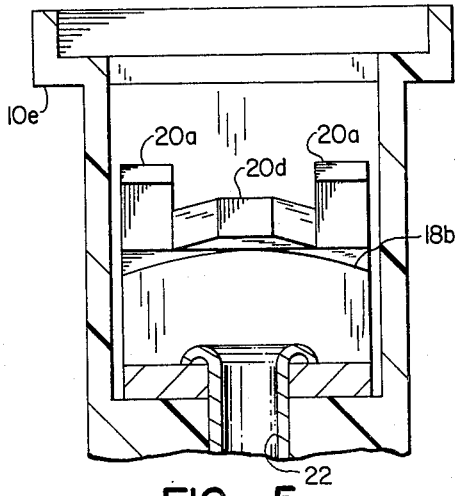
FIG. 5 is a vertical sectional view taken generally on the line 5—5 of FIG. 1.
Figure 6:
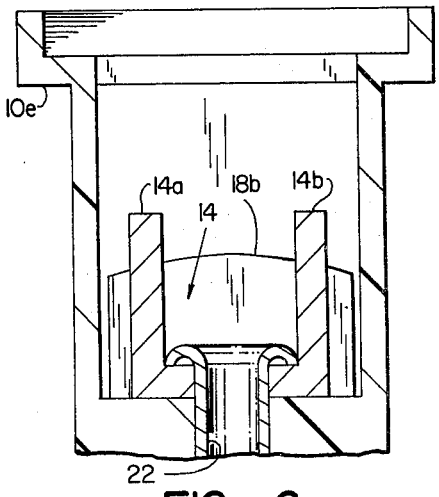
FIG. 6 is a vertical sectional view taken generally on the line 6—6 of FIG. 4.

Turning now to the drawings in greater detail, FIG. 1 shows a progressive switch incorporating the present invention and comprising an insulated switch case 10 of generally upwardly open box-like shape molded from a suitable electrically insulating material, such as Bakelite or the like. FIG. 3 shows the case 10 as including opposed side walls 10*a*, 10*b* integrally connected to opposed end walls 10*c* and 10*d*. The bottom wall 12 of the switch case 10 is of thicker construction then these side and end walls, and serve as a platform for the mounting of several fixed contacts 14, 16 and 18. Each of these contacts is spaced longitudinally from the other such that the upper edges thereof define an irregular path of movement best illustrated by the successive positions for a horizontally movable contact element 20. Each of these fixed contacts 14, 16 and 18 is preferably secured to the lower wall or floor 12 of the plastic case 10 by a rivet 22, 22. The upper end of the rivet is secured to a flat portion of the particular fixed contact as illustrated in FIGS. 5 and 6 for example, and the lower end of each such rivet preferably supports a depending post or terminal 24 best shown in FIG. 1.

The switch case 10 is otherwise of conventional construction and includes a metal cover plate 26 having ear portions 26*a* adapted to be bent into the position shown for securing the cover 26 to the upper end of the case 10. A peripheraly extending flange 10*e* is provided integrally at the upper end portions of the side walls of the case and these ear portions are secured to this flange. The metal cover 26 includes upstanding flange portions 26*b*, each of which defines an opening adjacent the apex thereof for loosely receiving a rivet 28 so that a rocker type actuator 30 can be pivotally supported between these side plates 26*b*.

It will be apparent that other type actuators may also be substituted for the rocker shown at 30, and the important feature of the present invention is that the actuator 30 includes a depending portion 30*a* which is adapted to support a compression spring 32, which spring 32 is adapted to act, indirectly on the floating contact 20 through the plunger 34, to maintain the movable contact element 20 in yieldable engagement with the upper edge portions of the various fixed contacts 14, 16 and 18. The plunger 34 thus comprises a part of the actuator means which includes the external portion 30 and also the spring biasing means 32.

Turning now to a more complete description of the fixed contacts 14, 16 and 18, the "off" position for the switch of FIG. 1 is provided when the movable contact element 20 is located in the extreme right hand view, depicted schematically by the line of action 31 for the depending portion of the actuator 30, and by the broken line position for movable contact element 20. As so positioned, contact element 20 has its underside 20*a*, and more particularly laterally spaced regions thereof, in engagement with the upper edges of laterally opposed leg portions 14*a* and 14*b* of the fixed contact 14. Thus, first contact defining means 14 comprises a generally U-shaped sheet metal part as viewed in lateral cross section, and as best shown in FIG. 6. The upper edges of this U-shaped fixed contact 14 are inclined slightly as viewed in FIG. 1 so as to facilitate sliding action of the movable contact element 20 as it is moved from the "off" position, shown in broken lines in FIG. 1, to the intermediate "on" position represented by the line of action 33 for the rocker or actuating means in this view.

Figure 4:
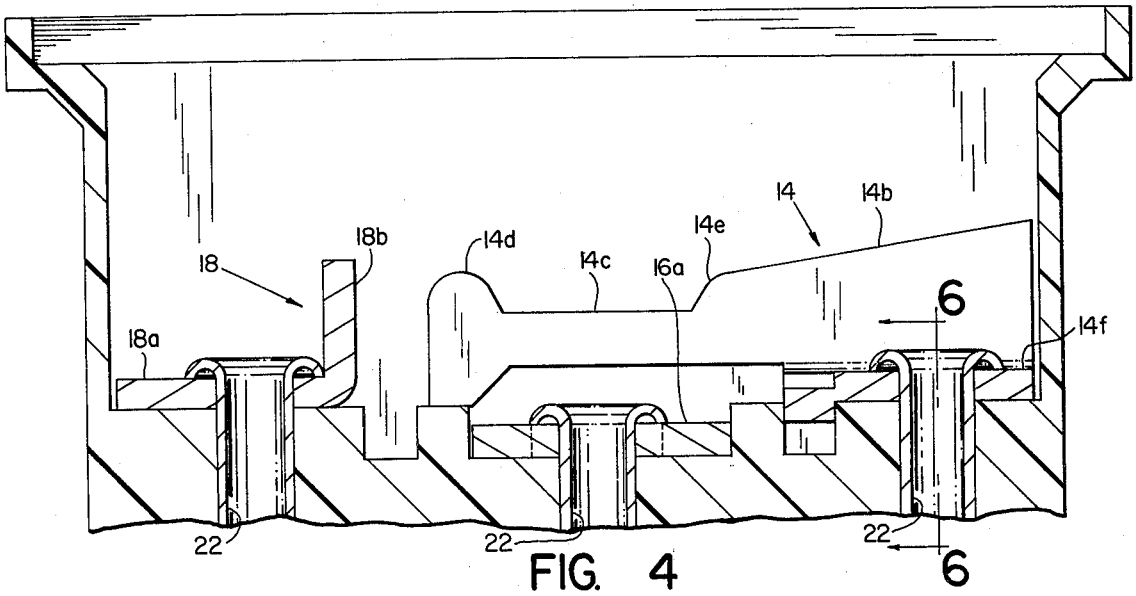
FIG. 4 is a vertical sectional view taken generally on the line 4—4 of FIG. 3.

As best shown in FIG. 4, the upper edge 14*b* of first fixed contact 14 includes a longitudinally projecting portion 14*c* defining an upwardly open recess, between protuberance or fulcrum defining portion 14*d* and ramp surface 14*e*, where movable contact element 20 can be conveniently nested therebetween (see FIG. 1 and the intermediate position for the contact element 20 there shown). The second fixed contact defining means 16 has precisely the same contour as projecting portion 14*c*, including the protuberance or fulcrum defining portion 16*d* which is laterally aligned with and identical to that described above with reference to reference numeral 14*d* and the first contact defining means 14.

It will be apparent from a comparison of FIGS. 1–3 that second fixed contact 16 has a generally L-shape, with the upwardly projecting leg of the L defining this complimentary surface 16*d* which cooperates with the rear surface 14*c* of the first contact 14 to slidingly engage and support the movable contact element 20 in the intermediate position shown in FIG. 1. A horizontally extending leg of the L-shaped second contact 16, best shown in FIG. 4 at 16*a*, is secured to the switch case floor by rivet 22. FIG. 4 also shows the web 14*f* of the U-shaped first contact 14 to be similarly secured to the floor of the switch case by rivet 22.

The third fixed contact 18 is also of generally L-shaped, but the L is rotated 90 degrees from that of the second fixed contact 16 described above. Thus, the horizontally extending leg 18*a* of the third contact 18 is secured to the lower wall of the switch case 10 by rivet 22, and the upstanding leg of the L indicated generally at 18*b* is provided with a convex upper edge designed to engage the forward laterally extending edge of movable contact 20, at least when the latter is in the third position shown in full lines in FIG. 1. The rear, or other laterally extending edge of movable contact element 20 is adapted to be supported by the fulcrum defining protuberances 14*d* and 16*d* referred to previously. In this third switch position contact element 20 bridges the third contact and both the first and second contact through these protuberances. These protuberances 14*d* and 16*d* act upon spaced regions on the underside of the slidable contact element 20 so as to pivot it in a clockwise manner as the actuator 30 is moved from the intermediate position, represented by the line 33, to the solid line position 35 causing positive contact between the underside of the element 20 and the upper edge 18*b* of the third contact 18.

The movable or slidable contact element 20 is of generally rectangular planform as best shown in FIG. 2, and includes upturned laterally extending leading and trailing edge portions 20*a* and 20*b* respectively. A central opening of tapered contour 20*c* is provided centrally of the element 20 and serves to receive the tip of plunger 34 in order to cause sliding movement of the element 20 in response to the above described motion of the actuator 30. Spring 32 is provided to yieldably urge the element 20 against the upper edges of the fixed contacts described above with reference to reference numerals 14, 16 and 18. Finally, a tab 20*d* is provided in a segment of the forward or one laterally extending edge 20*a* of the movable contact element 20 in order to maintain a switch closed or "on" position while the actuator 30 is moved from the position shown back toward the intermediate position suggested by the line 33 in FIG. 1. FIG. 5 shows to best advantage the contact between this projecting portion 20*d* of the movable contact element 20 in the upper edge 18*b* of the fixed third contact 18.

We claim:

1. A progressive switch comprising a case, actuator means movably mounted in the case, a movable contact connected to said actuator means for longitudinal movement therewith, first, second, and third fixed contacts in said case, said first, second, and third contacts disposed generally along the longitudinal path of movement of said movable contact, said first fixed contact having a U-shaped cross sectional configuration, said movable contact having a width to span the upper edges of the legs of said U-shaped first contact when in a first position, said second contact having an L-shaped cross sectional configuration with one side of the L generally aligned with one leg of the U-shaped first contact, said other leg of said U-shaped first contact having a projecting portion with an upper edge shaped to complement the upper edge of said one side of said L-shaped second contact so that said movable contact spans said complementary upper edges of said first and second contacts when in a second position, and said third contact so spaced longitudinally from said complementary upper edges as to support one laterally extending edge of said movable contact while the opposite laterally extending edge of said movable contact is supported by portions of said complementary upper edges to define a third position for said movable contact wherein all three fixed contacts are adapted to be progressively connected through said movable contact.

2. A progressive switch comprising a case, actuator means movably mounted in said case, a movable contact connected to said actuator for movement horizontally of said case between first, second and third positions, first, second and third fixed contacts disposed generally along the horizontal path of movement of said movable contact, said first contact having a portion for engaging laterally spaced regions of said movable contact, and said first contact also defining a projecting portion arranged alongside said second contact such that said movable contact regions engage said first and second fixed contacts in said second position for said movable contact, and said third fixed contact so spaced longitudinally from said second contact as to engage one laterally extending edge of said movable contact when said movable contact has its other laterally extending edge still in contact with said first and second fixed contacts.

3. The progressive switch of claim 2 wherein said second contact and a projecting portion of said third contact define laterally spaced complementary contact surfaces for said movable contact regions, each of said complementary surfaces having fulcrum defining segments which cooperate with another laterally extending edge of said movable contact to define said third position, and which fulcrum defining segments also cooperate with said one laterally extending edge of said movable contact to define said second position, said movable contact comprising a generally rectangular element having upturned laterally extending edges to facilitate movement of said contact element between said first, second and third successive positions.

4. The progressive switch of claim 3 wherein said actuator means comprises a spring biasing said movable contact into engagement with said fixed contacts, the biasing force nevertheless allowing said movable contact element to tilt as said contact element moves generally longitudinally over said fulcrum defining segments from said second to said third positions.

5. The progressive switch of claim 4 wherein said first fixed contact has an abutment portion adjacent a first movable contact element position defining portion, said abutment portion so located longitudinally as to engage said other laterally extending edge of said movable contact element in the second position of said contact element.

6. The progressive switch of claim 5 wherein said first fixed contact has a U-shaped cross sectional configuration and said regions of said movable contact supported at the upper edges of the legs of said U-shape in said first position.

7. The progressive switch of claim 6 wherein said second fixed contact has an L-shape cross sectional configuration with one side generally aligned with one leg of the U-shaped first fixed contact, the other leg of said U-shaped first contact having said projecting portion extending longitudinally with an upper edge shaped to complement the upper edge of said one side of said L-shaped second contact and said fulcrum defining segments also defined by said complementary upper edges and cooperable with said movable contact.

8. The progressive switch of claim 7 wherein said third contact comprises a laterally extending blade with a convexly contoured upper edge, said movable contact having its one laterally extending edge defining a projection for engaging said third contact blade, said projection moving between said legs of said U-shaped first contact and said L-shaped second contact.

9. The progressive switch of claim 2 wherein said actuator means includes a member pivotally mounted in said case and wherein said actuator means further includes a depending portion received in a recess defined by said movable contact, and biasing means urging said movable contact into engagement with said first, second and third fixed contacts.

10. The progressive switch of claim 3 wherein said actuator means includes a member pivotally mounted in said case and wherein said actuator means further includes a depending portion received in a recess defined by said movable contact, and biasing means urging said movable contact into engagement with said first, second and third fixed contacts.

11. In a switch of the type having a plastic case, a plastic actuator pivotally mounted in the case, and spring biased means associated with a depending portion of the actuator to cause movement of a generally rectangular metal contact element across the upper ends of fixed metal contacts in the bottom wall of the switch case, the improvement comprising first fixed contact defining means including upwardly facing surface means contoured to slidably engage laterally spaced regions on the underside of the movable contact element to support the movable contact element in a first position, second fixed contact defining means having an upper edge closely adjacent to but spaced below said upwardly facing surface means of said first contact defining means, and a projecting portion of said first fixed contact defining means laterally spaced from and aligned with said upper edge of said second fixed contact defining means, said second fixed contact defining means and said projecting portion of said first fixed contact defining means also including laterally spaced and aligned protuberances defining abutments which cooperate with said upwardly facing adjacent first contact defining means to determine a second position for said movable contact element slightly below said first position wherein said first and second contact defining means are electrically connected through said movable element.

12. The switch of claim 11 further characterized by a third contact defining means spaced from said protuberances and having a laterally extending upper edge, said movable contact element being movable from said second position to a third position wherein said element is supported by both said protuberances and said laterally extending upper edge.

* * * * *